United States Patent [19]

Corbett

[11] Patent Number: 4,777,997

[45] Date of Patent: Oct. 18, 1988

[54] EVAPORABLE FOAM PATTERN FOR CYLINDER BLOCK OF A TWO-CYCLE ENGINE

[75] Inventor: William D. Corbett, Fond du Lac, Wis.

[73] Assignee: Brunswick Corporation, Skokie, Ill.

[21] Appl. No.: 172,655

[22] Filed: Mar. 24, 1988

[51] Int. Cl.[4] ..... B22C 7/02; B22C 9/04

[52] U.S. Cl. ..... 164/246; 164/34; 164/45

[58] Field of Search ..... 164/246, 235, 249, 34, 164/35, 36, 45

[56] References Cited

U.S. PATENT DOCUMENTS

| | | | |
|---|---|---|---|
| 4,093,018 | 6/1978 | Trumbauer | 164/246 X |
| 4,197,899 | 4/1980 | Ernest | 164/235 X |
| 4,632,169 | 12/1986 | Osborn et al. | 164/45 |
| 4,640,333 | 2/1987 | Martin et al. | 164/246 |
| 4,657,063 | 4/1987 | Morris | 164/246 X |

FOREIGN PATENT DOCUMENTS

| | | | |
|---|---|---|---|
| 61-266147 | 11/1986 | Japan | 164/45 |

*Primary Examiner*—Nicholas P. Godici
*Assistant Examiner*—J. Reed Batten, Jr.
*Attorney, Agent, or Firm*—Andrus, Sceales, Starke & Sawall

[57] ABSTRACT

The pattern comprises an engine block component having at least one generally cylindrical internal wall that defines a cylinder. A head encloses one end of the cylinder while the opposite end of the cylinder is open to the crankcase end of the block. One or more longitudinally extending recesses or cavities are formed in the cylinder wall. Each recess has a base portion spaced radially outward from the wall and a generally curved end spaced from the head. A separate evaporable foam strip or insert is secured across the recess and is spaced from the base portion to provide a longitudinal transfer passage, while an end of the insert is spaced from the curved end of the recess to define a transfer port that communicates with the cylinder. The longitudinal edges of the wall bordering the recess can diverge in a direction toward the axis of the cylinder, and the longitudinal edges of the insert are similarly contoured to mate with the edges of the wall. The mating edges are joined by an adhesive.

13 Claims, 2 Drawing Sheets

FIG. 1
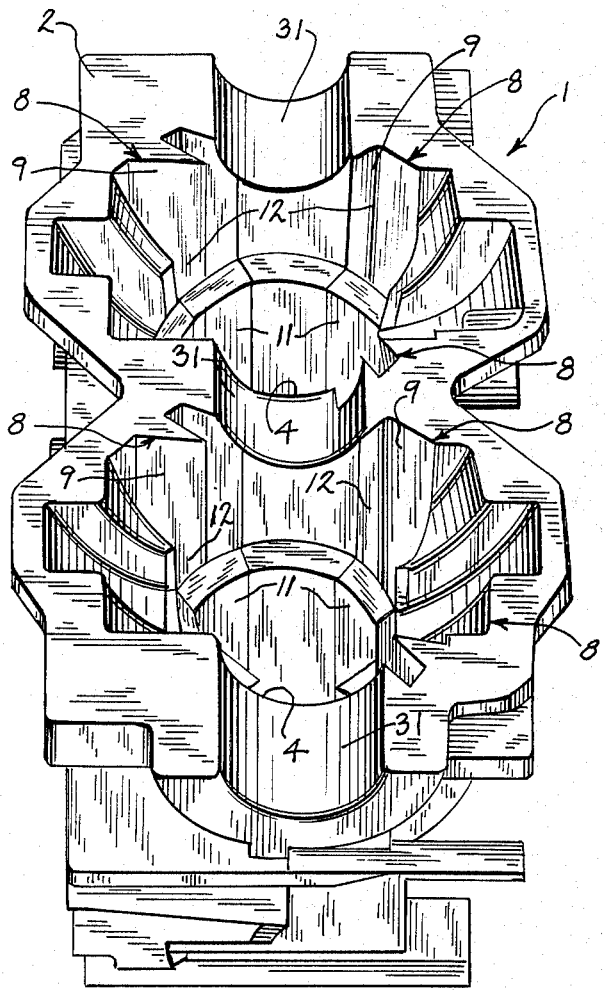
FIG. 3
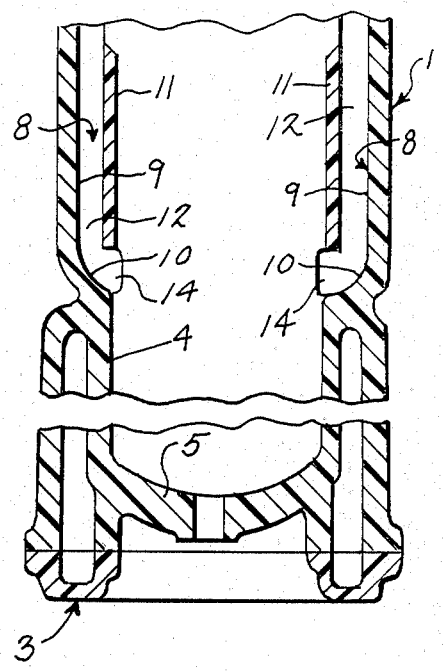
FIG. 2
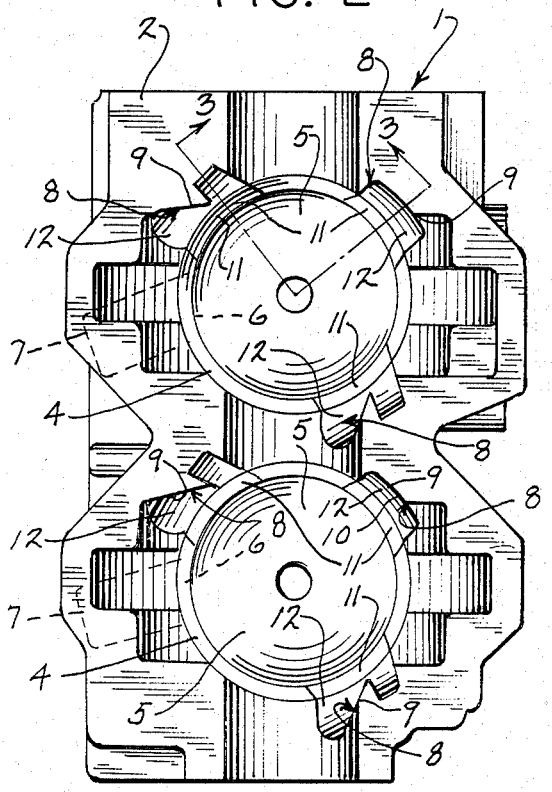
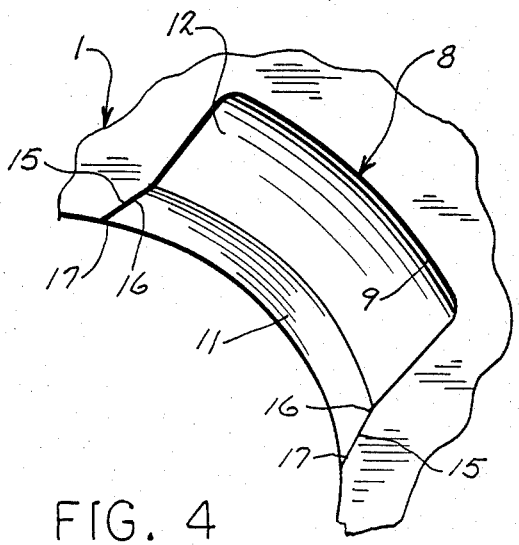
FIG. 4

EVAPORABLE FOAM PATTERN FOR CYLINDER BLOCK OF A TWO-CYCLE ENGINE

BACKGROUND OF THE INVENTION

Cylinder blocks of two-cycle cranckase compression engines are normally fabricated by die casting. Recently, there has been increased activity in fabricating the cylinder block by a lost foam process in which the pattern is made from an evaporable foam material, such as polystyrene.

In the typical lost foam process, the pattern is placed in a mold and a flowable material, such as sand, is disposed around the pattern and within the cavities in the pattern. During casting, the heat of the molten metal will vaporize the pattern and the vapor will be dispersed in the interstices of the sand, while the metal fills the area vacated by the foam material.

The fabrication of an evaporable foam pattern for a two-cycle engine has proven difficult due to the complexity of the porting in the engine block and particularly the transfer ports. A typical two-cycle engine includes one or more transfer passages through which the fuel-air charge is drawn to the cylinder. The discharge end of the transfer passage constitutes a transfer port which must be positioned in precise tolerance with respect to the cylinder head so that the fuel-air stream will flow in the desired course to the head and then flow to the exhaust port to affect removal of the spent gases.

It has been proposed to fabricate a cylinder block pattern for a two-cycle in a series of sections, with each section being cut laterally through the axes of the cylinders. The sections are then glued together along mating interfaces to form the cylinder block pattern. By properly selecting the positions of the interfaces of the sections, it is possible to produce a pattern with the desired porting. However, as a cylinder block pattern of this type is formed of a group of glued up sections, it is difficult to maintain the proper tolerance between the transfer ports and the cylinder head, thereby increasing the machining cost for the die cast metal block. Further, any excess glue, which may extrude from the joints between pattern sections will generally extend transversely to the transfer passages and the extruded glued joint will result in a transverse bead of metal in the cast metal cylinder block which can adversely affect the flow of the fuel-air charge through the transfer passages.

SUMMARY OF THE INVENTION

The invention is directed to an improved evaporable foam pattern for a cylinder block of a two-cycle engine. In accordance with the invention, the pattern comprises an evaporable foam engine block component having at least one generally cylindrical internal wall that defines a cylinder. One end of the cylinder is enclosed by a head, while the opposite end of the cylinder is open to the crankcase end of the block.

One or more recesses or cavities are formed in the cylinder wall and extend longitudinally of the axis of the cylinder. Each recess is formed with a base portion spaced radially outward from the cylinder wall and has a generally curved discharge end which is spaced from the head.

A separate evaporable foam strip or insert is secured across the recess and the inner surface of the insert is flush and forms an extension to the cylinder wall. The insert is spaced radially from the base portion of the recess to provide a longitudinal transfer passage, and the end of the insert is spaced longitudinally from the curved discharge end of the recess to define a transfer port that communicates with the cylinder.

In a preferred form of the invention, the longitudinal edges that border the recess diverge outwardly in a direction toward the axis of the cylinder, and the longitudinal edges of the insert are similarly contoured to mate with the longitudinal edges of the recess. The mating edges are joined together by a glue or adhesive.

As the curved discharge end of the transfer passage is formed integrally with the cylinder head in the pattern, the desired precise tolerance can be maintained between the transfer port and the head to obtain optimum efficiency of combustion.

Any adhesive or glue that is extruded out of the adhesive joint into the transfer passage extends longitudinally, and not transversely of the passage. Thus, any resulting bead of metal in the final cast engine block resulting from the extruded bead of glue will not interfere with flow of the fuel-air charge through the transfer passage.

Further, if there is any lack of glue or adhesive on the longitudinal joints between the insert and the block along the inner surface of the insert which can result in a depression or groove in the cylinder wall of the cast metal block, such groove will be in the low pressure area of the cylinder and will not interfere with action of the piston.

As the transfer passages extend continuously to the crank case end of the block, it is contemplated that separate, semi-cylindrical evaporable foam inserts can be secured by adhesive to the crankcase end of the block to provide increased bearing support areas, if desired.

Other objects and advantages will appear in the course of the following description

DESCRIPTION OF THE DRAWINGS

The drawings illustrate the best mode presently contemplated of carrying out the invention.

In the drawings:

FIG. 1 is a perspective view of the crankcase end of the cylinder block pattern of the invention;

FIG. 2 is a crankcase end view of the pattern;

FIG. 3 is a section taken along line 3—3 of FIG. 2;

FIG. 4 is an enlarged fragmentary view of the crankcase end of the pattern;

DESCRIPTION OF THE ILLUSTRATED EMBODIMENT

Figure 5:
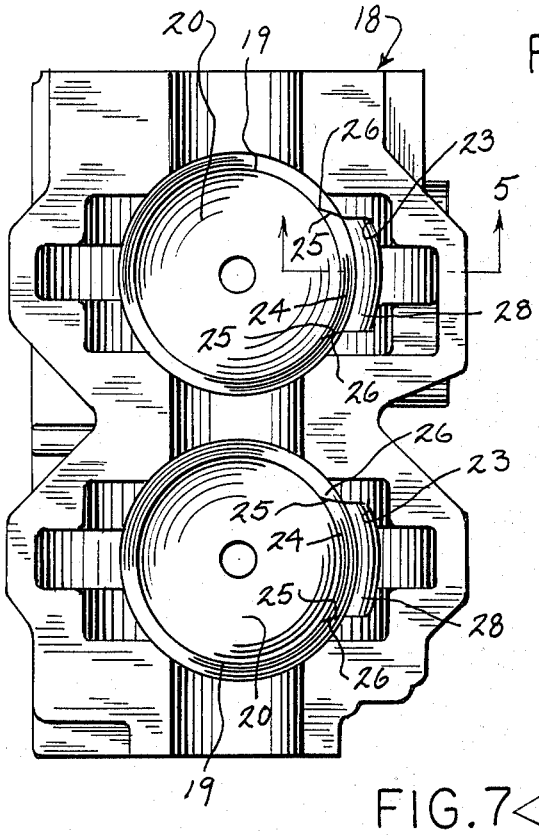
FIG. 5 is a crankcase end view of a modified form of the invention employing a crossflow system.

FIG. 1 illustrates an evaporable foam pattern 1 for a cylinder block of a crankcase compression two-cycle engine. The pattern is formed of an evaporable foam material, such as polystyrene, and is used in a lost foam casting process for casting a metal cylinder block. As the cast metal block is identical in configuration to the pattern, terminology of the components of the metal cylinder block will be used in describing the evaporable foam pattern.

The cylinder block pattern 1 includes a crankcase end 2 and a head end 3. In addition, the complete pattern also includes an exhaust manifold cover pattern, an exhaust manifold water jacket cover pattern and a cylinder head water jacket pattern, all of which are not shown in the drawings but are adapted to be attached to the cylinder block pattern 1 by glue or adhesive.

Block pattern 1 includes a plurality of cylinders 4 having parallel axes and one end of each cylinder is enclosed by a dome shaped head 5, while the opposite end of each cylinder is open to the crankcase end 2 of the pattern.

An exhaust port 6 is formed in each cylinder 4 and communicates with an exhaust passage 7.

As best shown in FIG. 2, block 1 operates on a loop charge system and is formed with a plurality of transfer recesses or cavities 8, and as illustrated, three such cavities are shown for each cylinder 4. Each cavity 8 extends longitudinally of the respective cylinder, and each cavity is provided with a base 9 which is spaced radially outward of the cylinder wall 4. The discharge end of each cavity 8 terminates in a generally curved end 10 which is spaced from head 5, as best shown in FIG. 3, while the other end of the cavity 8 is open to the crankcase end 2 of the pattern.

A separate evaporable foam insert or strip 11 is secured across each cavity 8, as best illustrated in FIG. 2. The inner surface of each insert is curved to complement the cylinder wall, while the outer surface of the insert is spaced from the base 9 of the cavity or recess to provide a longitudinally extending transfer passage 12.

As shown in FIG. 3, the upper end of each insert 11 terminates short of curved discharge end 10 to define a transfer port 14 that establishes communication between transfer passage 12 and cylinder 4.

The longitudinal edges 15 bordering each cavity 8 preferably diverge outwardly from each other in a direction toward the axis of the cylinder, as best shown in FIG. 4, and similarly, the longitudinal side edges 16 of insert 11 diverge outwardly and mate with the edges 15. The mating edges 15 and 16 are joined by a layer of glue or adhesive 17, such as commonly used in last foam casting processes.

Figure 6:
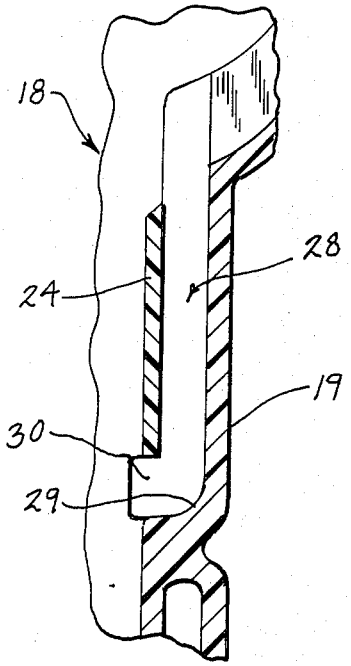
FIG. 6 is a section taken along line 5—5 of FIG. 5.

FIGS. 5 and 6 illustrate the invention as associated with a cross flow system. An evaporable foam engine block pattern 18, similar to pattern 1 of the first embodiment, includes a plurality of cylinders 19, each of which is enclosed by a dome-shaped head 20. Each cylinder is formed with an exhaust port, not shown, which communicates with an exhaust passage formed in the pattern. In addition, a longitudinally extending recess or cavity 23 is associated with each cylinder 19, and cavities 23 are similar in function to cavities 8. A generally curved evaporable foam insert 24 is secured across each cavity 23 and the mating diverging side edges of the insert and the pattern, 25 and 26 respectively, are joined together by glue or an adhesive layer.

As described in connection with the first body, the outer surface of the insert 24 is spaced from the base of the cavity 23 to provide a transfer passage 28, and the end of the insert is spaced from the curved discharge end 29 of the cavity to provide a transfer port 30.

In the construction of the invention, the discharge ends of the transfer passages are integrally formed, in the same pattern piece, with the cylinder heads so that precise tolerance can be maintained between these members, thus assuring proper flow of the fuel-air mixture as well as the spent gases to obtain optimum efficiency of combustion.

If any adhesive, such as 17, is extruded out of the longitudinal joints 15,16 or 25,26 into the transfer passages, the extruded bead will result in a corresponding bead of metal in the final cast metal cylinder block. However, any such metal bead will extend longitudinally of the transfer passage so that it will not interfere with flow of the fuel-air mixture through the passage.

If there is a lack of glue along the longitudinal joins 15,16 or 25,26, such lack of glue will result in a depression or groove in the cylinder wall of the cast metal block. However, any such groove will extend longitudinally of the cylinder, and as it is in a low pressure area, it will not interfere with action of the piston, nor will the piston rings catch on the groove.

Figure 7:
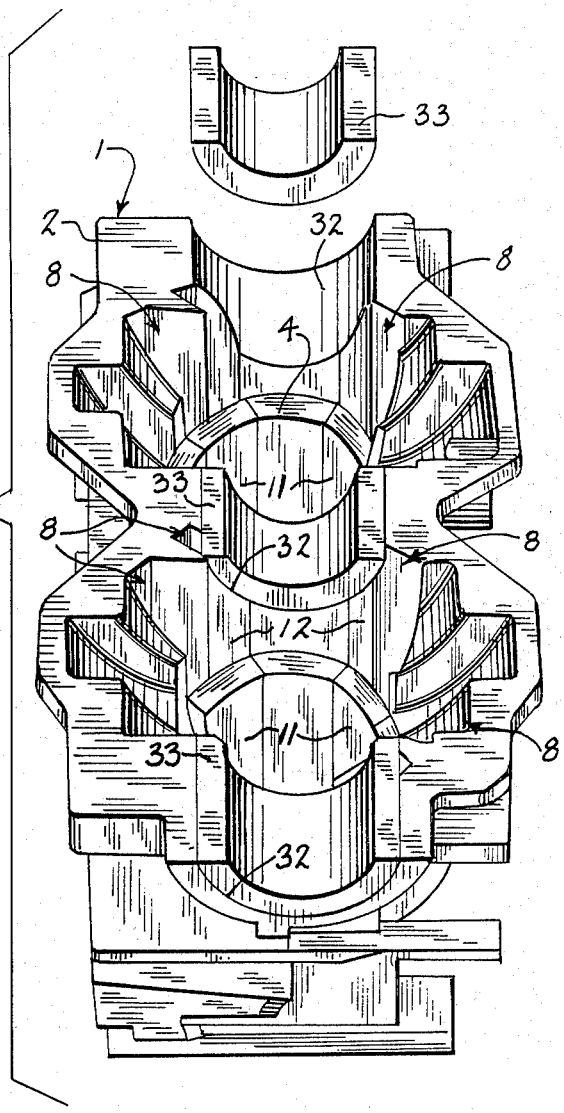
FIG. 7 is an exploded perspective view of a modified form of the cylinder block pattern.

In the embodiment shown in FIGS. 1–4, the transfer passages 12 extend to the crankcase end 2 of the block and at least some of the transfer passages interrupt the generally semi-circular bearing support surfaces 31. If, for a particular engine, it is desired to increase the bearing support area, the crank-case end 2 of the pattern 1 can be formed with enlarged semi-cylindrical concave surfaces 32, as shown in FIG. 7, and separate evaporable foam arcuate inserts 33 can be secured to surfaces 32 by a glue or adhesive. The arcuate inserts 33 provide an enlarged bearing support surface and partially close off the ends of the transfer passages 12.

Various modes of carrying out the invention are contemplated as being within the scope of the following claims particularly pointing out and distinctly claiming the subject matter which is regarded as the invention.

I claim:

1. An evaporable polymeric foam pattern for forming a cylinder block of a two cycle engine, comprising an evaporable foam engine block component having an internal generally cylindrical wall defining a cylinder and having a head end and having an open opposite crankcase end, recess means disposed in said wall and extending longitudinally of said cylinder, said recess means having a base portion spaced radially from said wall and having a discharge end spaced from said head end, a separate evaporable foam insert disposed circumferentially across said recess means, said insert being spaced from said base portion to provide a longitudinal transfer passage therebetween, a first end of said insert being spaced longitudinally from said discharge end of said recess means to provide a transfer port providing communication between said cylinder and the transfer passage, and means for joining said insert to said block component.

2. The pattern of claim 1, wherein said means for joining said insert to said block component comprises a layer of adhesive.

3. The pattern of claim 1, wherein said wall has a pair of spaced longitudinal edges that border said recess means, said edges diverging outwardly in a direction toward the axis of said cylinder.

4. The pattern of claim 3, wherein said insert has a pair of longitudinal side edges that diverge outwardly in a direction toward the axis of said cylinder and mate with the longitudinal edges of said wall.

5. The pattern of claim 1, wherein the inner surface of said insert is curved and forms an extension to said wall.

6. The pattern of claim 1, and including a head enclosing the head end of said cylinder.

7. An evaporable foam pattern for forming a cylinder block of a two-cycle engine in a lost foam casting process, comprising an evaporable foam engine block component having an internal generally cylindrical wall defining a cylinder and having a head end and having an open opposite crankcase end, at least one recess disposed in said wall and extending longitudinally of said cylinder, said recess having a base portion spaced radially from said wall and having a generally curved discharge end spaced from said head end and having an opposite end opening at the crankcase end of said block component, a separate evaporable foam insert disposed circumferentially across said recess, said insert being spaced from said base portion to provide a longitudinal transfer passage therebetween, a first end of said insert being spaced longitudinally from said discharge end of said recess to define a transfer port providing communication between said cylinder and said transfer passage, and a layer of adhesive joining said insert to said block component.

8. The pattern of claim 7, wherein the crankcase end of said block component is provided with a bearing support concavity disposed normal to the axis of said cylinder and communicating with said cylinder, said opposite end of said recess intersecting said concavity.

9. The pattern of claim 8, and including a second evaporable foam insert secured in said concavity and at least partially closing off the opposite end of said recess, the outer surface of said second insert defining a semi-cylindrical bearing support surface.

10. The pattern of claim 7, and including a head enclosing the head end of said cylinder.

11. The pattern of claim 9, and including a second layer of adhesive joining said second insert to said concavity.

12. The pattern of claim 7, wherein said insert has a second end opposite said first end and spaced longitudinally of the crankcase end of said block component.

13. The pattern of claim 7, wherein said wall has a pair of spaced longitudinal edges that border said recess, said edges diverging outwardly in a direction toward the axis of said cylinder, said insert having a pair of longitudinal side edges that diverge outwardly in a direction toward the axis of said cylinder and mate with the longitudinal edges of said wall.

* * * * *

Notice of Adverse Decisions in Interference

In Interference No. 102,176, involving Patent No. 4,777,997, W. D. Corbett, EVAPORABLE FOAM PATTERN FOR CYLINDER BLOCK OF A TWO-CYCLE ENGINE, final judgement adverse to the patentee was rendered July 19, 1990, as to claims 1-7, 12 and 13.

[*Official Gazette October 23, 1990*]